US010166458B1

(12) United States Patent
Khamitov

(10) Patent No.: US 10,166,458 B1
(45) Date of Patent: Jan. 1, 2019

(54) SKI POLE BASKET AND SKI POLE WITH SUCH SKI POLE BASKET

(71) Applicant: KV2 Sagl, Dongio (CH)

(72) Inventor: Taoufik Khamitov, Torre (CH)

(73) Assignee: KV2 Sagl, Dongio (CH)

( * ) Notice: Subject to any disclaimer, the term of this patent is extended or adjusted under 35 U.S.C. 154(b) by 0 days.

(21) Appl. No.: 16/106,356

(22) Filed: Aug. 21, 2018

(30) Foreign Application Priority Data

Sep. 18, 2017 (EP) ..... 17191586

(51) Int. Cl.
*A63C 11/24* (2006.01)
*A63C 11/22* (2006.01)
*A45B 9/04* (2006.01)

(52) U.S. Cl.
CPC ..... *A63C 11/24* (2013.01); *A45B 9/04* (2013.01); *A63C 11/227* (2013.01)

(58) Field of Classification Search
CPC ..... A63C 11/24
USPC ..... 280/824
See application file for complete search history.

(56) References Cited

U.S. PATENT DOCUMENTS 2,721,084 A * 10/1955 Weiss ..... A63C 11/24 280/824
3,199,886 A * 8/1965 Dover ..... A63C 11/222 135/84
3,202,436 A * 8/1965 Barreea ..... A63C 11/22 280/824
4,093,250 A * 6/1978 Wikstrand ..... A63C 11/24 280/824
4,336,949 A * 6/1982 Aho ..... A63C 11/24 280/824
4,676,525 A * 6/1987 Sorlien ..... A63C 11/24 280/824
4,955,969 A * 9/1990 Jansson ..... A63C 11/22 280/824
6,203,064 B1 * 3/2001 Zaltron ..... A63C 11/24 280/824
7,926,849 B2 * 4/2011 Lenhart ..... A63C 11/24 280/824
8,434,790 B2 * 5/2013 Lenhart ..... A45B 9/04 280/824
8,505,975 B2 * 8/2013 Karlof ..... A63C 11/24 280/809
8,973,946 B2 * 3/2015 Carr ..... A63C 11/222 280/816
9,138,034 B2 * 9/2015 Donnadieu ..... A45B 9/04
9,713,759 B2 * 7/2017 Liebner ..... A63C 11/24

* cited by examiner

*Primary Examiner* — Jeffrey J Restifo
(74) *Attorney, Agent, or Firm* — Nadya Reingand; Yan Hankin

(57) ABSTRACT

The invention relates to a ski pole basket having at least a barrel shaped body (2) of the basket, wherein a thread (21) of the body extends along the body (2) of the basket at least from one open end face of the body to the opposite end face of the body, and on the opposite end face of the body an end piece (3) of the basket is attached, and a nut (5) that is formed so that it is slidably moveable on the ski pole shaft and enterable into a thread joint with the body (2) of the basket. According to the invention the ski pole basket comprises a sleeve (4) that is made fixedly attachable to the ski pole shaft by means of a sleeve (4), wherein at least on one open end face of the sleeve a circumferential collar (41) of the sleeve is formed.

10 Claims, 7 Drawing Sheets

SKI POLE BASKET AND SKI POLE WITH SUCH SKI POLE BASKET

CROSS-REFERENCES TO RELATED APPLICATIONS

The present patent application claims priority to European patent application EP17191586.1 filed Sep. 18, 2017.

FIELD OF INVENTION

The invention relates to a ski pole basket having at least a barrel shaped basket body, wherein a thread of the body extends along the basket body at least from one open end face of the body to the opposite end face of the body, and on the opposite end face of the body an end piece of the basket is attached, as well as a nut that can slidably move along the shaft of the ski pole and enter a thread joint with the basket body.

Moreover the invention relates to a ski pole having at least a ski pole shaft, a thrust handle and a ski pole basket according to the invention.

BACKGROUND

In the equipment of skiers, ski poles play an important role, which are currently manufactured mainly of composite alloys.

A ski pole consists of a shaft, a thrust handle with a strap (a sling to hold the handle on the wrist) and a support element with a heavy end piece, the so-called basket of the ski pole.

Currently there are several variants of ski pole baskets provided for different conditions of ski contests and/or trainings. The basic types of such baskets are: a basket for hard snow, a basket for soft snow and a basket for ski rollers. The latter is provided for ski rollers or for use on asphalt and has a thicker lower pobedit end piece. Theoretically it can be used also for Nordic walking. Other variants are also possible.

Usually the ski pole basket is glued to the shaft of the ski pole by means of hot adhesive, and when it needs to be exchanged (in the event of a fracture or for use on a different kind of snow or asphalt) the ski pole basket is heated, disassembled and, after hot adhesive has been added, a new one is put on. Such an exchange can be carried out only in stationary circumstances and takes a long time. Hence ski pole baskets for quick disassembly were developed.

Thus from prior art a ski pole basket for quick disassembly is known, manufactured by the Norwegian company SWIX (see FIG. 1). This ski pole basket includes a barrel shaped basket body on the outer surface of which the bowl-shaped tab of the basket is attached. On the basket body an outer thread of the body is formed, extending from the open end face of the body to the opposite end face of the body. On the opposite end face of the body the end piece of the basket is attached. In the area of the outer thread of the body, the body of the basket is divided into three annular segments (sectors) by means of through-going grooves extending approximately parallel to the longitudinal axis of the body. Additionally the ski pole basket includes a nut that can slidably move along the shaft of the ski pole and can enter a thread joint with the body of the basket, the nut being shaped as a covering cap.

In the present solution the attachment of the ski pole basket on the shaft of the ski pole is done without adhesive. First the nut is placed on the shaft of the ski pole. Subsequently the body of the basket is moved onto the lower part of the ski pole shaft. Thereafter the nut is screwed onto the thread of the body, the nut pressing the annular segments of the basket body, which are movable to a predetermined degree, to the shaft of the ski pole, thus fixating the basket body thereon.

This solution carries a number of disadvantages. First, when the basket body is moved onto the ski pole shaft, the position must be manually fine-tuned and continually checked so that the basket of the ski pole faces backwards when the skier moves (that is, the correct radial arrangement of the basket body must be ensured). Second, when the clamping of the nut loosens, the basket body starts to rotate around the ski pole shaft and to slide downward on it; to prevent his, the skier must check it continually.

SUMMARY

Based on the foregoing, the problem to be solved by the invention is the creation of a technical solution providing for a quick exchange of the ski pole basket, which does not have the abovementioned shortcomings.

The problem is solved by means of a ski pole basket according to the invention comprising a sleeve that can be rigidly fixed on the ski pole shaft, wherein on at least one open end face of the sleeve a circumferential collar of the sleeve is formed, and from the collar of the sleeve a guiding ridge of the sleeve extends to the opposite end face of the sleeve, wherein the thread of the body is formed on the inner surface of the basket body, and a guiding recess of the body formed in the basket body extends from the thread of the body to the opposite end face of the body, and wherein the ridge of the sleeve is formed so that it can engage with the recess of the body when the sleeve is moved into the basket body and can be attached in the recess of the body by placing the nut on the collar of the sleeve.

Thus the essence of the invention lies in the application of a sleeve, that is formed in a special way, which is rigidly fixed (for instance, glued) on the shaft of the ski pole and which provides immobility and the correct spatial orientation of the basket body during utilisation.

In a preferred embodiment of the invention at least one protrusion of the collar extending approximately parallel to the longitudinal axis of the sleeve is formed on the collar of the sleeve, while on the inner surface of the nut at least one groove of the nut is formed extending approximately parallel to the longitudinal axis of the nut, wherein the protrusion of the collar is formed so that it can engage with the groove of the nut when the nut enters into thread joint with the basket body.

This solution enables the user (the sportsman) to continuously control the contact between the basket body and the nut visually and acoustically, and prevents the latter from spontaneously coming unscrewed.

In a preferred embodiment of the invention the ski pole basket is formed like a basket for a ski roller pole. In another preferred embodiment of the invention a bowl-shaped tab of the basket extends from the outer surface of the basket body. In this embodiment of the invention the ski pole basket is formed like a ski pole basket for hard snow or like a ski pole basket for soft snow. Due to this the invention encompasses the basic possibilities for use of a ski pole and makes it unnecessary for the sportsman to have different ski poles for different conditions of use.

The problem to be solved by the invention is also the creation of a ski pole meeting the abovementioned requirements. The problem is solved by utilising a ski pole basket according to the invention in a ski pole.

DETAILED DESCRIPTION OF THE PREFERRED EMBODIMENT

Figure 1:
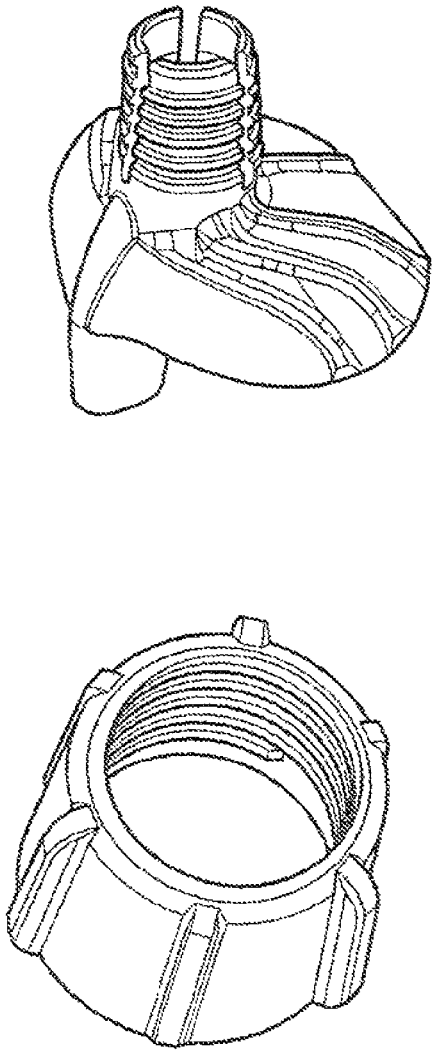
Prior Art Fig. 1
FIG. 1 is a ski pole basket known from prior art by the company SWIX.
Figure 2:
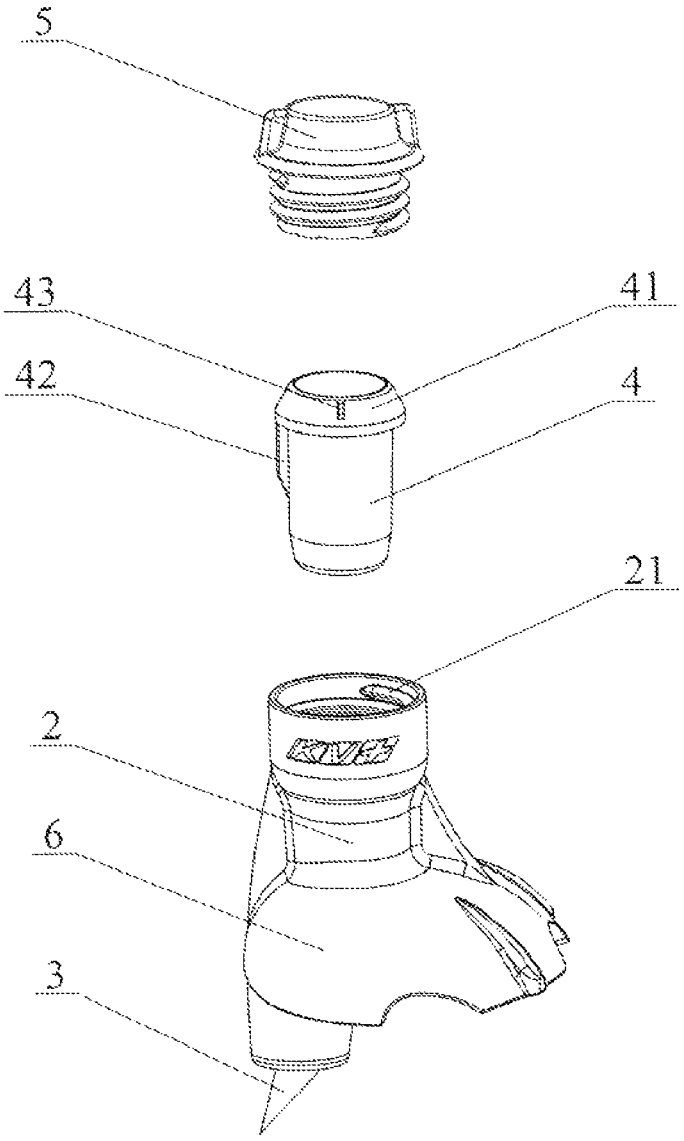
FIG. 2 is an illustration of one embodiment of the ski pole basket according to the invention in a disassembled view.

FIG. 2 shows an embodiment of the ski pole basket according to the invention in a disassembled view. The ski pole basket includes a body 2 of the basket, a sleeve 4 and a nut 5.

Figure 5:
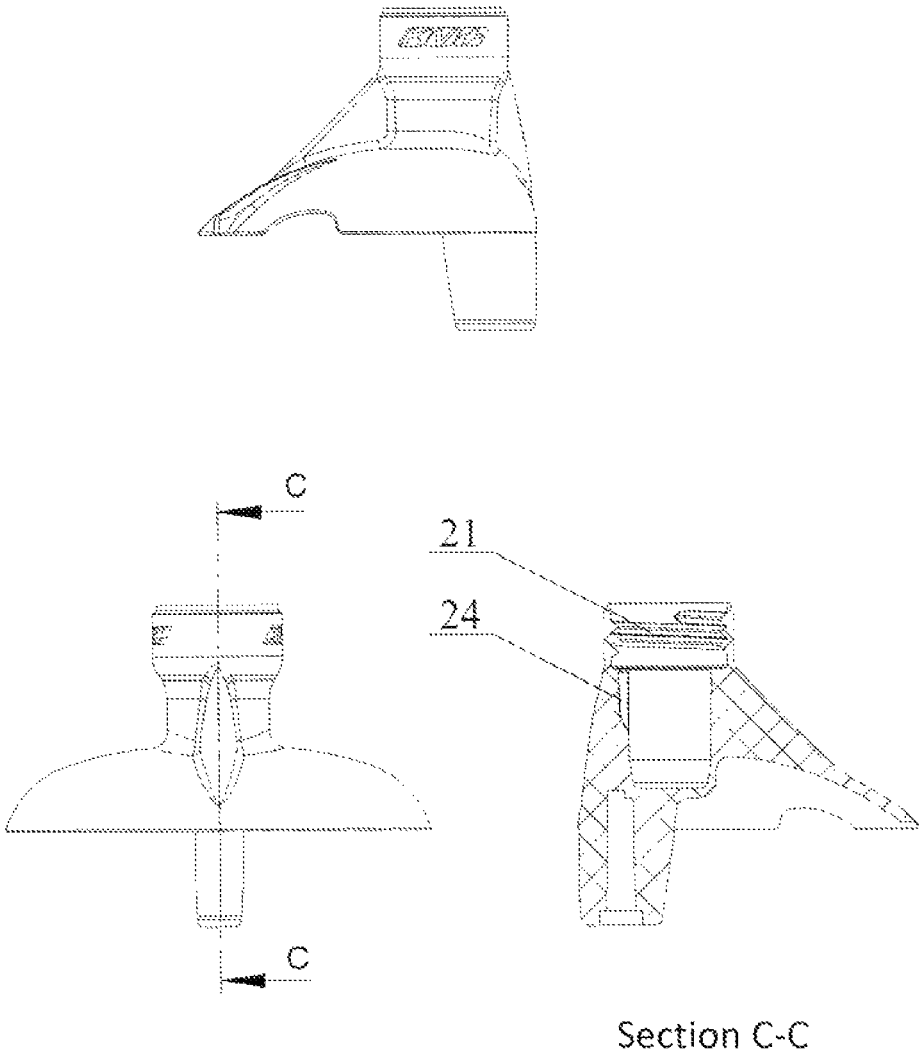
FIG. 5 is an illustration of the basket body according to the invention (front view, side view, section through plane C-C)
Figure 8:
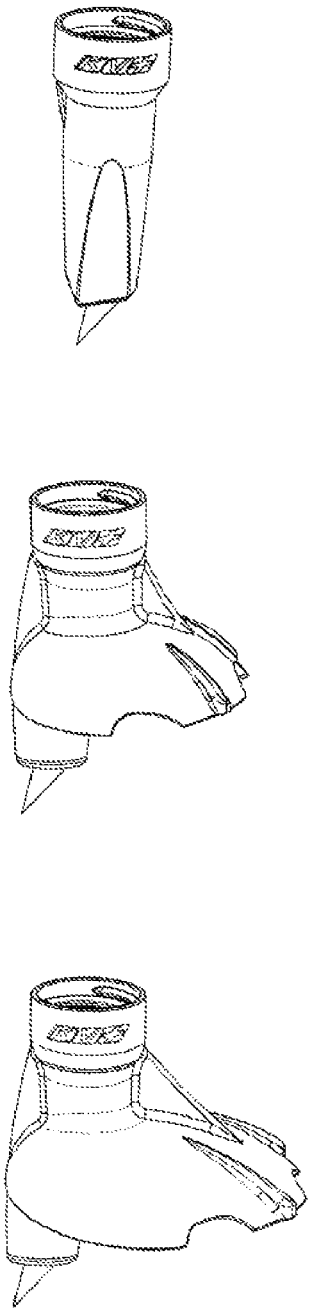
FIG. 8 is an illustration showing several embodiments of the basket body according to the invention.

The body 2 of the basket (see also FIG. 5) is barrel shaped. A thread 21 of the body extends along the body 2 of the basket from one open end face of the body to the opposite end face of the body along the inner surface of the body 2 of the basket. On the opposite end face of the body, which can be formed open or closed, an end piece 3 of the basket manufactured from a hard alloy (for instance pobedit) is attached. If the ski pole basket is formed like a basket of a ski pole for snow, from the outer surface of the body 2 extends a bowl-shaped tab 6 of the basket, the size of which depends on the softness of the snow (the harder the snow the smaller the size of the basket, the softer the snow the larger the size of the basket, see also FIG. 8). The spatial position of the tab 6 of the basket can be additionally fixed by means of at least one, preferably several, stiffening ribs extending between it and the body 2 of the basket. If the ski pole basket is formed as a basket for ski rollers, the tab 6 of the basket is omitted, while the end piece 3 of the basket is formed thicker. A guiding recess 24 of the body which is formed on the inner surface of the body 2 of the basket extends from the thread 21 of the body to the opposite end face of the body.

Figure 3:
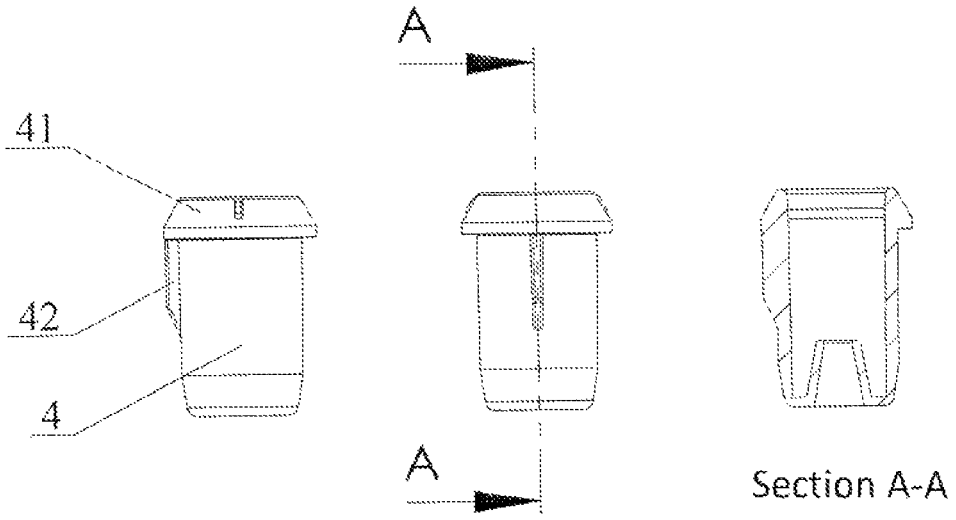
FIG. 3 is an illustration of the sleeve according to the invention (front view, side view, section through plane A-A)

The sleeve 4 (see also FIG. 3) is formed so that it can be rigidly fixed (for instance by means of hot adhesive) on the ski pole shaft. To achieve this, its inner diameter is somewhat larger than the outer diameter of the ski pole shaft (usually 8.5 mm or 9.5 mm). Other dimensions are also possible.

On one open end face of the sleeve a circumferential collar 41 of the sleeve is formed, which in the present embodiment is conically chamfered. A guiding ridge 42 of the sleeve extends from the collar 41 of the sleeve to the opposite end face at least on a part of the outer surface of the sleeve. It is also possible that the ridge 42 extends over the entire length of the outer surface of the sleeve 4. The ridge 42 of the sleeve corresponds in size and shape to the recess 24 of the body. The other end face of the sleeve 4, which can be formed open or closed, can also be conically chamfered.

Figure 4:
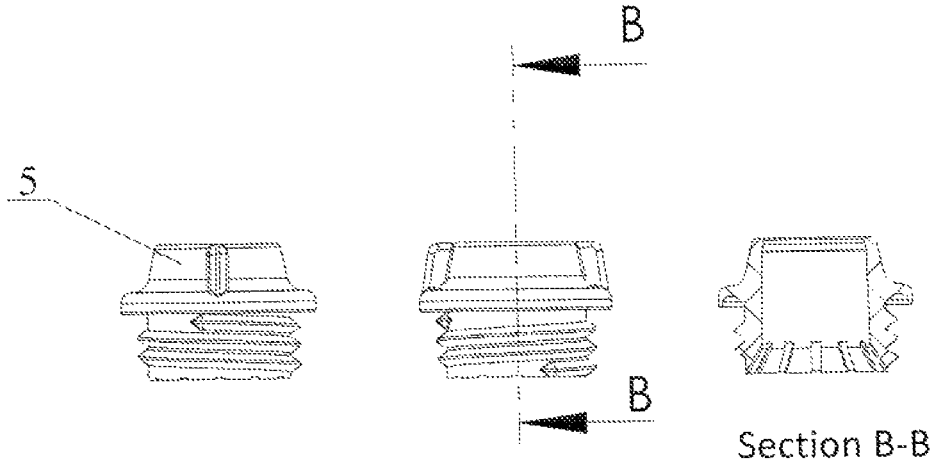
FIG. 4 is an illustration of the nut according to the invention (front view, side view, section through plane B-B)

The nut 5 (see also FIG. 4) is formed in a way that allows a sliding movement along the shaft of the ski pole and an entering into a thread joint with the body 2 of the basket. To achieve this, the inner diameter of the nut 5 is larger that the outer diameter of the ski pole shaft. The diameter of the outer thread of the nut 5 corresponds to the diameter of the inner thread of the body 2 of the basket. In the present embodiment a nut skirt is formed on the nut, which, when the nut 5 enters the thread joint with the body 2 of the basket, is supported therein and rests on top of it.

Figure 6:
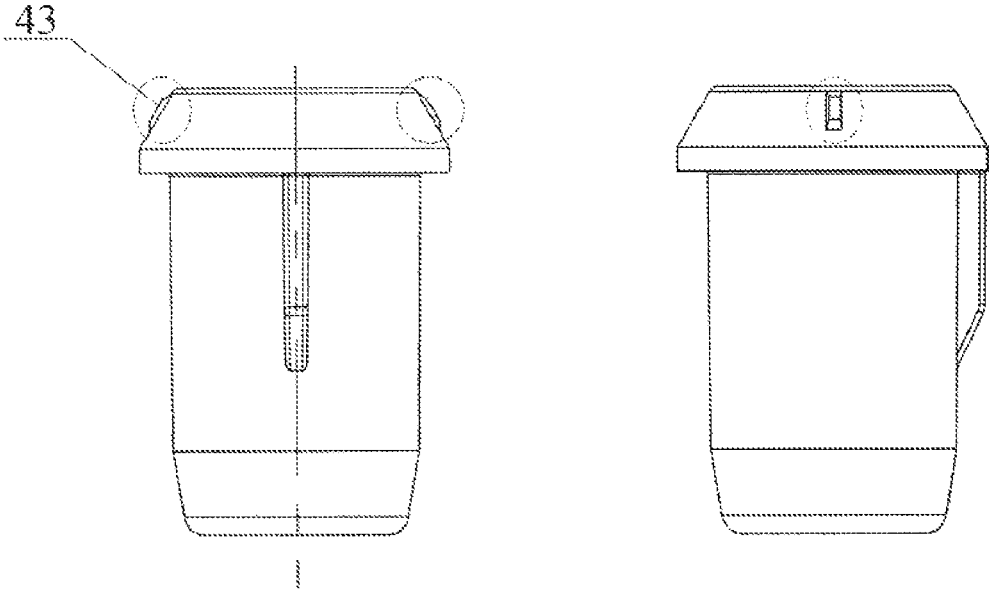
FIG. 6 is an illustration of the sleeve according to the invention with the collar protrusion in several views.
Figure 7:
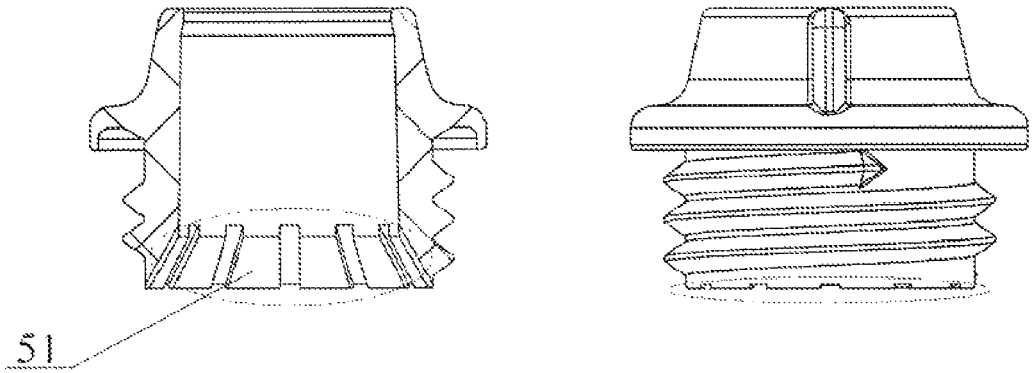
FIG. 7 is an illustration of the nut according the invention with the groove of the nut in several views.

At least one, preferably several protrusions 43 of the collar are formed on the collar 41 of the sleeve, extending approximately parallel to the longitudinal axis of the sleeve 4 (see FIG. 6, circled elliptically). At least one, preferably several grooves 51 of the nut are formed on the inner surface of the nut 5, extending approximately parallel to the longitudinal axis of the nut 5 and corresponding to the protrusion 43 of the collar (see FIG. 7, circled elliptically). Due to this the protrusion 43 of the collar engages with the groove 51 of the nut when the nut 5 enters the thread joint with the body 2 of the basket.

Figure 9:
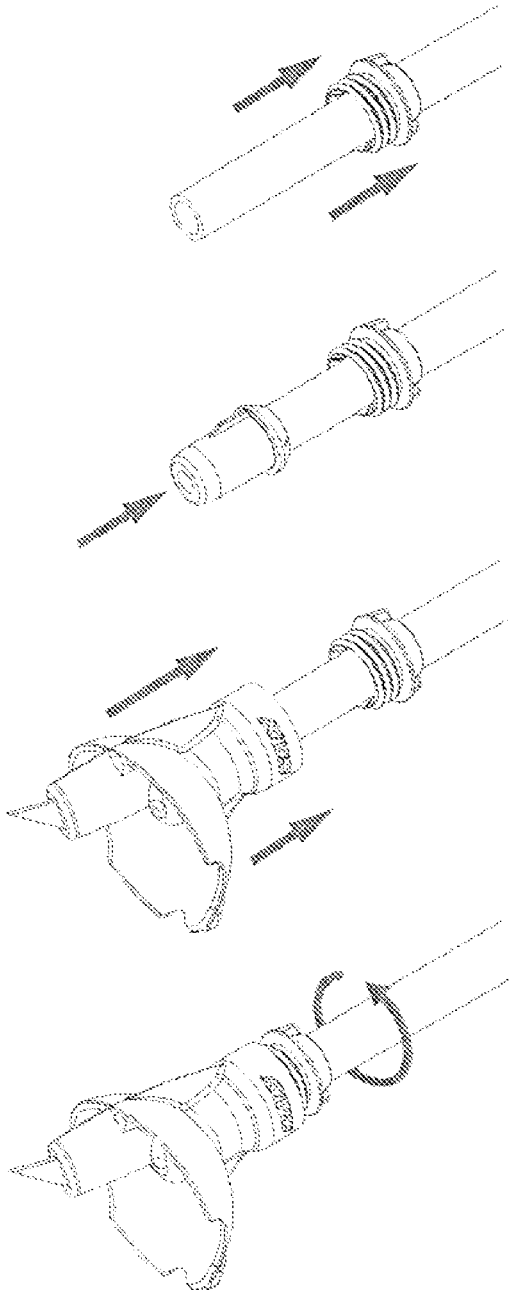
FIG. 9 is an illustration showing successive assembly steps of the ski pole basket according to the invention.

FIG. 9 illustrates the principle of interaction of the sleeve 4 and the nut 5 detached from the body 2 of the basket in their states of assembly.

First the nut 5 is placed on the lower part of the ski pole shaft. After heating, hot adhesive is applied to the lower part of the ski pole shaft and on the inside of the sleeve 4. The sleeve 4 is placed on the lower part of the ski pole shaft so that the ridge 42 of the sleeve is positioned away from the front part (in the direction of movement of the sportsman) of the ski pole shaft (shown by the light arrow), while the front part of the ski pole shaft is defined by the arrangement of the handle with the strap. Subsequently, depending on the purpose of use of the ski pole, the end piece for a ski roller or the ski pole basket for hard or soft snow is put on the sleeve 4, wherein, while the sleeve 4 is moved into the body 2 of the basket, the ridge 42 of the sleeve engages with the recess 24 of the body. Subsequently the nut 5 is screwed into the thread of the body 2 of the basket all the way to the stop, resting with its end face on the collar 41 of the sleeve and with the skirt of the nut on the body 2 of the basket. Due to this the nut 5, thrust against the sleeve 4, prevents the body 2 of the basket from falling out.

When the nut 5 is screwed in, the groove 51 of the nut engages with the protrusion 43 of the collar, which increases the reliability of the fixation of the nut 5. This causes a characteristic (clicking) sound that tells the user (the sportsman) that the nut 5 has been screwed in all the way to the stop.

INDUSTRIAL APPLICABILITY

The ski pole with a ski pole basket according to the invention can be widely used in skiing, providing excellent usage quality for hobbyists as well as for professionals.

The invention claimed is:

1. Ski pole basket (1), comprising at least:

a barrel shaped body (2) of the basket, wherein a thread (21) of the body extends along the body (2) at least from one open end face of the body to the opposite end face of the body, and on the opposite end face of the body an end piece (3) of the basket is attached, and a nut (5) being formed slidably moveable on the ski pole shaft and enterable into a thread joint with the body (2) of the basket, characterised in that the basket (1) is made fixedly attachable to the ski pole shaft by means of a sleeve (4), wherein at least on one open end face of the sleeve a circumferential collar (41) of the sleeve is formed, and a guiding ridge (42) of the sleeve extends from the collar (41) of the sleeve to the opposite end face of the sleeve (4), wherein the thread (21) of the body is formed on the inner surface of the body (2) of the basket, and a guiding recess (24) of the body formed in the body (2) of the basket extends from the thread (21) of the body to the opposite end face of the body, and wherein the ridge (42) of the sleeve is made to be engageable with the recess (24) of the body when the sleeve (4) is moved into the body (2) of the basket and fixedly attachable in the recess (24) of the body by means of resting the nut (5) against the collar (41) of the sleeve.

2. Ski pole basket (1) according to claim 1, characterised in that on the collar (41) of the sleeve at least one protrusion (43) of the collar is formed extending approximately parallel to the longitudinal axis of the sleeve (4), while on the inner surface of the nut (5) at least one groove (51) of the nut is formed extending approximately parallel to the longitudinal axis of the nut (5), wherein the protrusion (43) of the collar is made to be engageable with the groove (51) of the nut when the nut (5) enters a thread joint with the body (2) of the basket.

3. Ski pole having at least a ski pole shaft, a thrust handle and a ski pole basket, characterised in that the ski pole basket is implemented according to claim 2.

4. Ski pole basket (1) according to claim 1, characterised in that it is shaped like a basket of a ski roller pole.

5. Ski pole having at least a ski pole shaft, a thrust handle and a ski pole basket, characterised in that the ski pole basket is implemented according to claim 4.

6. Ski pole basket (1) according to claim 1, characterised in that a bowl-shaped tab (6) extends from the outer surface of the body (2) of the basket.

7. Ski pole basket (1) according to claim 6, characterised in that it is shaped as a ski pole basket for hard snow or as a ski pole basket for soft snow.

8. Ski pole having at least a ski pole shaft, a thrust handle and a ski pole basket, characterised in that the ski pole basket is implemented according to claim 7.

9. Ski pole having at least a ski pole shaft, a thrust handle and a ski pole basket, characterised in that the ski pole basket is implemented according to claim 6.

10. Ski pole having at least a ski pole shaft, a thrust handle and a ski pole basket, characterised in that the ski pole basket is implemented according to claim 1.

* * * * *